US008297059B2

(12) United States Patent
Lacy et al.

(10) Patent No.: US 8,297,059 B2
(45) Date of Patent: Oct. 30, 2012

(54) NOZZLE FOR A TURBOMACHINE

(75) Inventors: Benjamin Paul Lacy, Greer, SC (US); Gilbert Otto Kraemer, Greer, SC (US); Ertan Yilmaz, Glenville, NY (US); Patrick Benedict Melton, Horse Shoe, NC (US)

(73) Assignee: General Electric Company, Schenectady, NY (US)

( * ) Notice: Subject to any disclaimer, the term of this patent is extended or adjusted under 35 U.S.C. 154(b) by 778 days.

(21) Appl. No.: 12/357,638

(22) Filed: Jan. 22, 2009

(65) Prior Publication Data

US 2010/0180600 A1 Jul. 22, 2010

(51) Int. Cl.
*F02C 1/00* (2006.01)
*F02G 3/00* (2006.01)

(52) U.S. Cl. ..... 60/772; 60/737; 60/742

(58) Field of Classification Search ..... 60/748, 60/737, 742, 740
See application file for complete search history.

(56) References Cited

U.S. PATENT DOCUMENTS

| | | | | |
|---|---|---|---|---|
| 4,100,733 | A | 7/1978 | Striebel et al. | |
| 4,429,527 | A | 2/1984 | Teets | |
| 4,845,952 | A | 7/1989 | Beebe | |
| 5,193,346 | A | 3/1993 | Kuwata et al. | |
| 5,199,265 | A | 4/1993 | Borkowicz | |
| 5,235,814 | A | 8/1993 | Leonard | |
| 5,259,184 | A | 11/1993 | Borkowicz et al. | |
| 5,263,325 | A | 11/1993 | McVey et al. | |
| 5,339,635 | A | 8/1994 | Iwai et al. | |
| 5,490,378 | A | 2/1996 | Berger et al. | |
| 5,575,146 | A | 11/1996 | Borkowicz et al. | |
| 5,590,529 | A | 1/1997 | Joshi et al. | |
| 5,680,766 | A | 10/1997 | Joshi et al. | |
| 5,685,139 | A | 11/1997 | Mick et al. | |
| 5,778,676 | A | 7/1998 | Joshi et al. | |
| 5,865,030 | A | 2/1999 | Matsuhama | |
| 5,930,999 | A | 8/1999 | Howell et al. | |
| 6,019,596 | A | 2/2000 | Knopfel et al. | |
| 6,301,899 | B1 | 10/2001 | Dean et al. | |
| 6,363,724 | B1 | 4/2002 | Bechtel et al. | |
| 6,438,961 | B2 | 8/2002 | Tuthill et al. | |
| 6,442,939 | B1 | 9/2002 | Stuttaford et al. | |
| 6,453,673 | B1 | 9/2002 | Bechtel et al. | |
| 6,672,073 | B2 | 1/2004 | Wiebe | |
| 6,681,578 | B1 | 1/2004 | Bunker | |
| 6,895,755 | B2 * | 5/2005 | Steinthorsson et al. | 60/742 |
| 6,993,916 | B2 | 2/2006 | Johnson et al. | |
| 7,107,772 | B2 | 9/2006 | Chen et al. | |
| 7,412,833 | B2 | 8/2008 | Widener | |
| 7,506,510 | B2 * | 3/2009 | Thomson | 60/740 |
| 7,540,154 | B2 * | 6/2009 | Tanimura et al. | 60/742 |
| 7,556,031 | B2 | 7/2009 | Russell | |
| 7,886,991 | B2 | 2/2011 | Zuo et al. | |
| 2003/0010032 | A1 | 1/2003 | Stuttaford et al. | |
| 2005/0050895 | A1 | 3/2005 | Dorr et al. | |

(Continued)

*Primary Examiner* — Ehud Gartenberg
*Assistant Examiner* — Arun Goyal
(74) *Attorney, Agent, or Firm* — Cantor Colburn LLP

(57) ABSTRACT

A turbomachine includes a compressor, a combustor operatively connected to the compressor, and an injection nozzle operatively connected to the combustor. The injection nozzle includes a main body having a first end section that extends to a second end section to define an inner flow path. The injection nozzle further includes an outlet arranged at the second end section of the main body, at least one passage that extends within the main body and is fluidly connected to the outlet, and at least one conduit extending between the inner flow path and the at least one passage.

9 Claims, 4 Drawing Sheets

U.S. PATENT DOCUMENTS

2007/0062197 A1 3/2007 Hannum et al.
2008/0078160 A1 4/2008 Kraemer et al.
2009/0229269 A1 9/2009 Lacy et al.
2009/0249789 A1 10/2009 Zuo et al.
2010/0008179 A1 1/2010 Lacy et al.
2010/0031662 A1 2/2010 Zuo
2010/0101229 A1 4/2010 York et al.

* cited by examiner

NOZZLE FOR A TURBOMACHINE

FEDERAL RESEARCH STATEMENT

This invention was made with Government support under Contract No. DE-FC26-05NT42643, awarded by the US Department of Energy (DOE). The Government has certain rights in this invention.

BACKGROUND OF THE INVENTION

The subject matter disclosed herein relates to the art of turbomachines and, more particularly, to a nozzle for a turbomachine.

In general, gas turbine engines combust a fuel/air mixture that releases heat energy to form a high temperature gas stream. The high temperature gas stream is channeled to a turbine via a hot gas path. The turbine converts thermal energy from the high temperature gas stream to mechanical energy that rotates a turbine shaft. The turbine may be used in a variety of applications, such as for providing power to a pump or an electrical generator.

In a gas turbine, engine efficiency increases as combustion gas stream temperatures increase. Unfortunately, higher gas stream temperatures produce higher levels of nitrogen oxide (NOx), an emission that is subject to both federal and state regulation. Therefore, there exists a careful balancing act between operating gas turbines in an efficient range, while also ensuring that the output of NOx remains below mandated levels. Current integrated gasification combined cycle, multi-nozzle quiet combustor (IGCC MNQC) nozzles always burn fuel in a diffusion mode and dry low NOx (DLN1) primary nozzles sometimes burn in a diffusion mode. In the case of IGCC turbomachines a significant amount of diluent is required to maintain NOx at acceptable levels.

BRIEF DESCRIPTION OF THE INVENTION

According to one aspect of the invention, a turbomachine includes a compressor, a combustor operatively connected to the compressor, and an injection nozzle operatively connected to the combustor. The injection nozzle includes a main body having a first end section that extends to a second end section to define an inner flow path. The injection nozzle further includes an outlet arranged at the second end section of the main body, at least one passage that extends within the main body and is fluidly connected to the outlet, and at least one conduit extending between the inner flow path and the at least one passage.

According to another aspect of the invention, a method of introducing a combustible mixture into a turbomachine combustor includes introducing a first fluid into an inner flow path of an injection nozzle having a first end section that extends to a second end section defining a main body. The main body includes an outlet arranged at the second end section. The method further includes passing a second fluid into at least one passage extending through the main body at the second end, guiding the first fluid from the inner flow path into the at least one passage to mix with the second fluid to form a combustible mixture, and discharging the combustible mixture through the outlet into the turbomachine combustor.

According to yet another aspect of the invention, an injection nozzle for a turbomachine includes a main body having a first end section that extends to a second end section defining an inner flow path, an outlet arranged at the second end section of the main body, at least one passage that extends within the main body and is fluidly connected to the outlet, and at least one conduit extending between the inner flow path and the at least one passage.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

The terms "axial" and "axially" as used in this application refer to directions and orientations extending substantially parallel to a center longitudinal axis of a centerbody of a burner tube assembly. The terms "radial" and "radially" as used in this application refer to directions and orientations extending substantially orthogonally to the center longitudinal axis of the centerbody. The terms "upstream" and "downstream" as used in this application refer to directions and orientations relative to an axial flow direction with respect to the center longitudinal axis of the centerbody.

Figure 1:
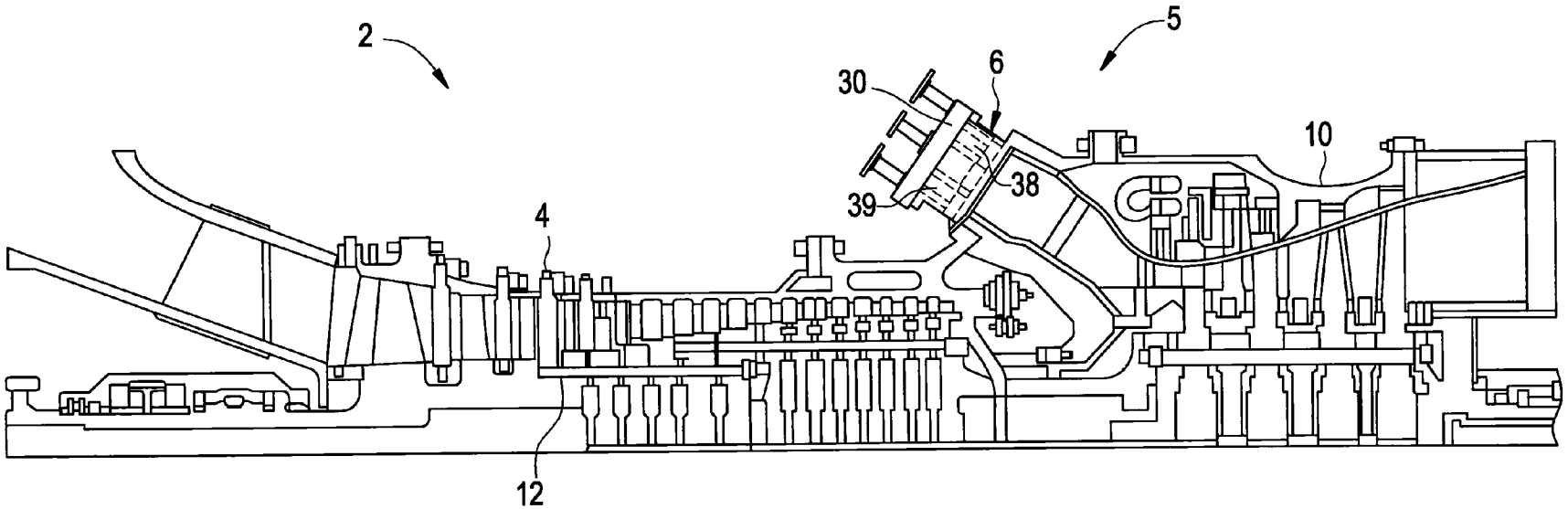
FIG. 1 is a cross-sectional side view of a turbomachine including an injection nozzle formed in accordance with exemplary embodiments of the invention.

With initial reference to FIG. 1, a turbomachine constructed in accordance with exemplary embodiments of the invention is generally indicated at 2. Turbomachine 2 includes a compressor 4 and a combustor assembly 5 having at least one combustor 6. Turbomachine engine 2 also includes a turbine 10 and a common compressor/turbine shaft 12. In one embodiment, gas turbine engine 2 is a PG9371 9FBA Heavy Duty Gas Turbine Engine, commercially available from General Electric Company, Greenville, S.C. Notably, the present invention is not limited to any one particular engine and may be used in connection with other gas turbine engines.

Figure 2:
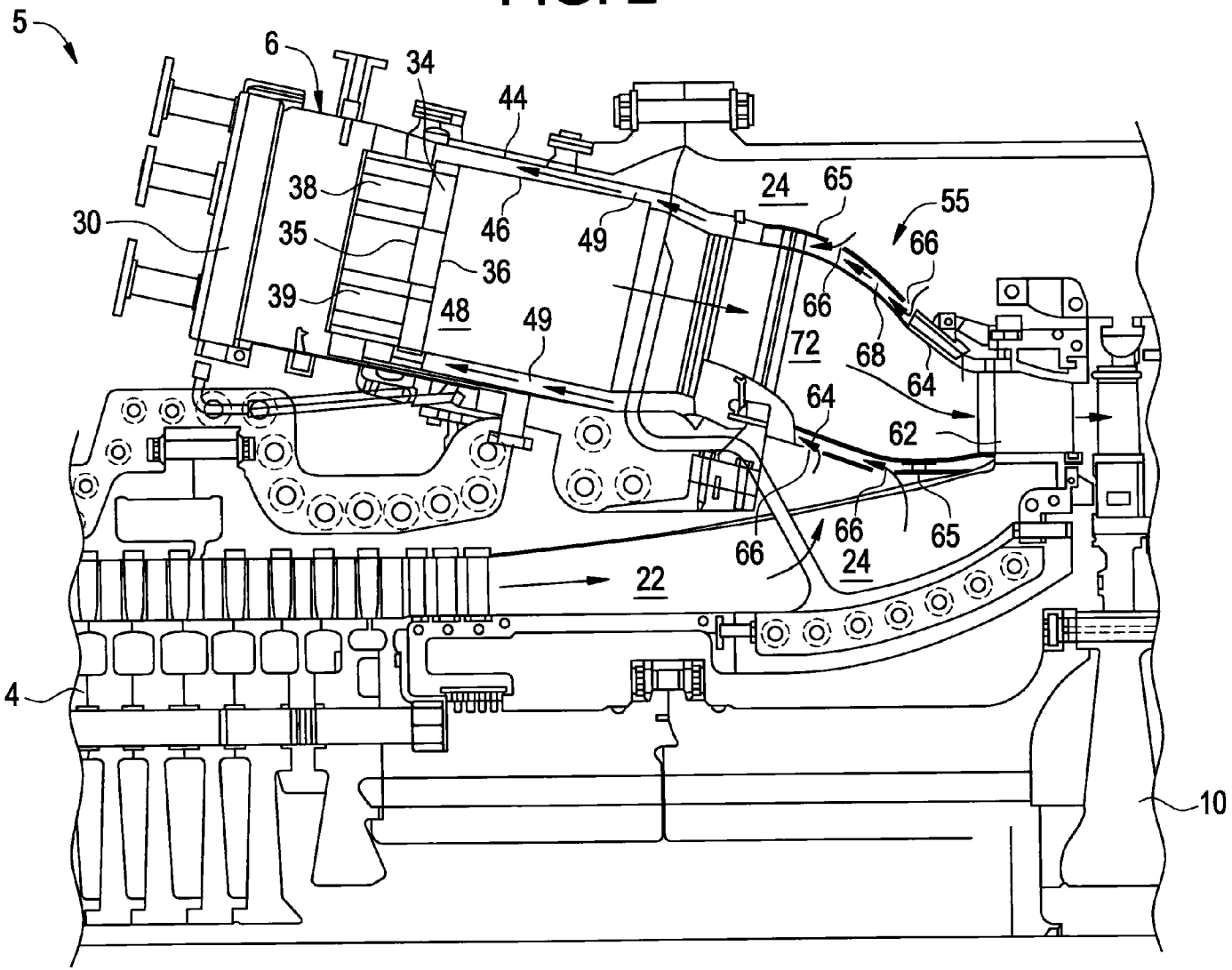
FIG. 2 is a cross-sectional view of a combustor portion of the turbomachine of FIG. 1.

As best shown in FIG. 2 combustor 6 is coupled in flow communication with compressor 4 and turbine 10. Compressor 4 includes a diffuser 22 and a compressor discharge plenum 24 that are coupled in flow communication with each other. Combustor 6 also includes an end cover 30 positioned at a first end thereof, and a cap member 34. Cap member 34 includes a first surface 35 and an opposing second surface 36. As will be discussed more fully below, a plurality of fuel or injection nozzles 38 and 39 are mounted to cap member 34. Combustor 6 further includes a combustor casing 44 and a combustor liner 46. As shown, combustor liner 46 is positioned radially inward from combustor casing 44 so as to define a combustion chamber 48. An annular combustion chamber cooling passage 49 is defined between combustor casing 44 and combustor liner 46. A transition piece 55 couples combustor 6 to turbine 10. Transition piece 55 channels combustion gases generated in combustion chamber 48 downstream towards a first stage turbine nozzle 62. Towards that end, transition piece 55 includes an inner wall 64 and an outer wall 65. Outer wall 65 includes a plurality of openings 66 that lead to an annular passage 68 defined between inner wall 64 and outer wall 65. Inner wall 64 defines a guide cavity 72 that extends between combustion chamber 48 and turbine 10.

During operation, air flows through compressor 4 and compressed air is supplied to combustor 6 and, more specifically, to injection nozzles 38 and 39. At the same time, fuel is passed to injection nozzles 38 and 39 to mix with the air and form a combustible mixture. The combustible mixture is channeled to combustion chamber 48 and ignited to form combustion gases. The combustion gases are then channeled to turbine 10. Thermal energy from the combustion gases is converted to mechanical rotational energy that is employed to drive shaft 12.

More specifically, turbine 10 drives compressor 4 via shaft 12 (shown in FIG. 1). As compressor 4 rotates, compressed air is discharged into diffuser 22 as indicated by associated arrows. In the exemplary embodiment, the majority of air discharged from compressor 4 is channeled through compressor discharge plenum 24 towards combustor 6, and the remaining compressed air is channeled for use in cooling engine components. Compressed air within discharge plenum 24 is channeled into transition piece 55 via outer wall openings 66 and into annular passage 68. Air is then channeled from annular passage 68 through annular combustion chamber cooling passage 49 and to injection nozzles 38 and 39. The fuel and air are mixed forming the combustible mixture that is ignited forming combustion gases within combustion chamber 48. Combustor casing 44 facilitates shielding combustion chamber 48 and its associated combustion processes from the outside environment such as, for example, surrounding turbine components. The combustion gases are channeled from combustion chamber 48 through guide cavity 72 and towards turbine nozzle 62. The hot gases impacting first stage turbine nozzle 62 create a rotational force that ultimately produces work from turbine 2.

At this point it should be understood that the above-described construction is presented for a more complete understanding of exemplary embodiments of the invention, which is directed to the particular structure of injection nozzles 38 and 39. However, as each injection nozzle 38, 39 is similarly formed, a detailed description will follow referencing injection nozzle 38 with an understanding that injection nozzle 39 includes similar structure.

Figure 3:
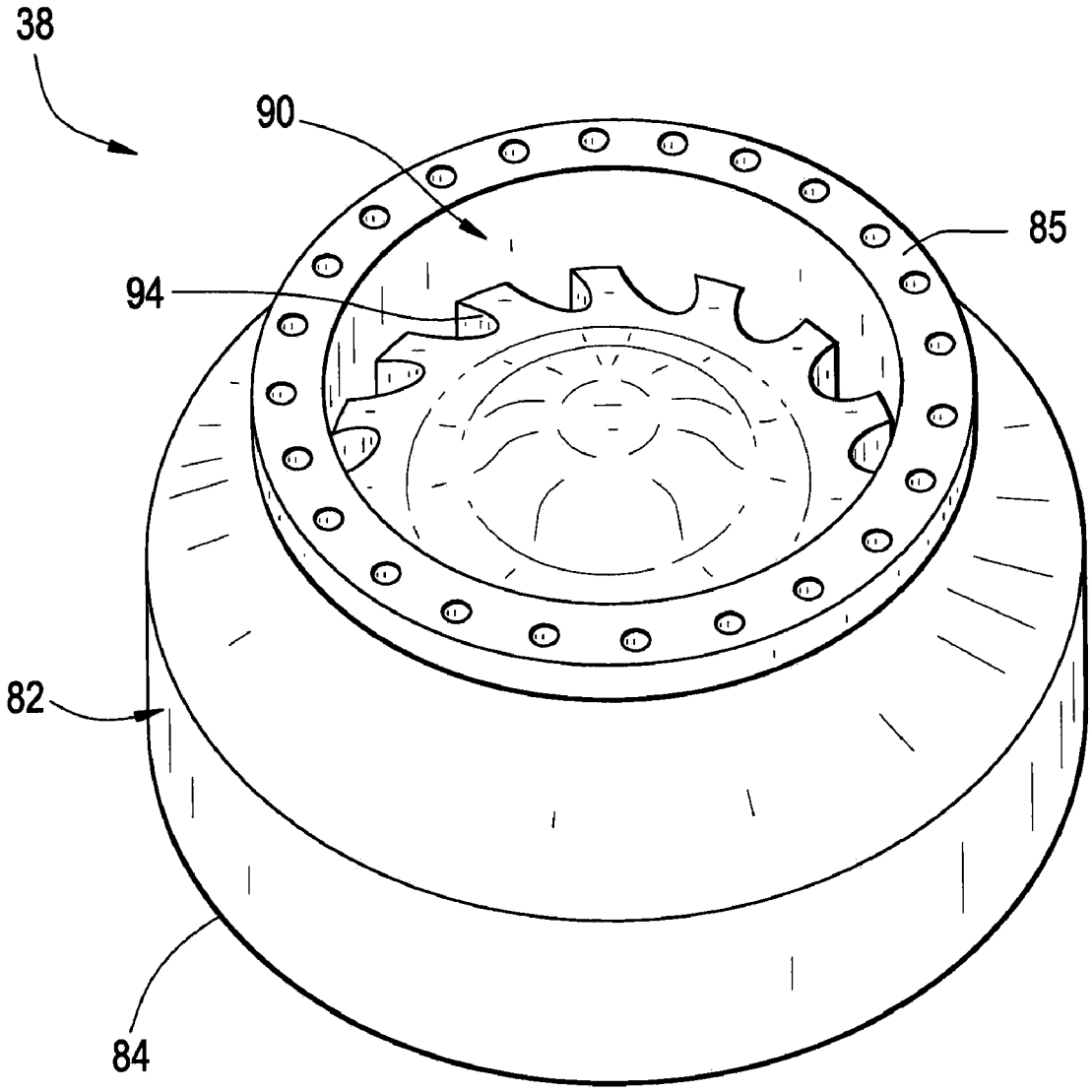
FIG. 3 is an upper perspective view of an injection nozzle constructed in accordance with an exemplary embodiment of the invention.
Figure 4:
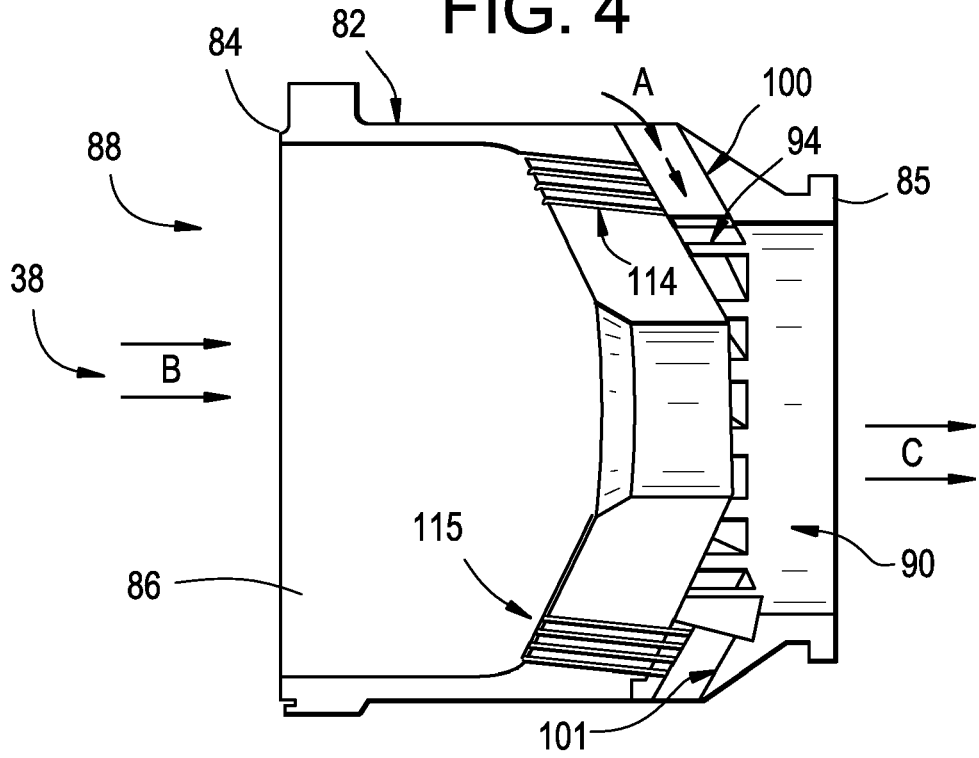
FIG. 4 is a cross-sectional view of the injection nozzle of FIG. 3.

As best shown in FIGS. 3 and 4, injection nozzle 38 includes a main body 82 having a first end section 84 that extends to a second end section 85 defining an interior cavity or inner flow path 86. First end section 84 includes an inlet 88 for receiving a first fluid, such as a fuel, and second end section 85 includes an outlet 90 through which passes a combustible mixture of fuel and air as will be described more fully below. Towards that end, injection nozzle 38 includes a plurality of discharge passage exits 94 arranged at outlet 90.

In accordance with the exemplary embodiment shown, injection nozzle 38 includes a first passage 100 and a second passage 101 that extend through main body 82. Although only two passages are shown, i.e., passages 100 and 101, it should be understood that a plurality of passages 100, 101 could be arrayed about main body 82. In any event, each passage 100, 101 is fluidly connected to the plurality of discharge passage exits 94 and inner flow path 86. More specifically, injection nozzle 38 includes a first plurality of conduits 114 that extend between inner flow path 86 and passage 100 and a second plurality of conduits 115 that extend between inner flow path 86 and second passage 101.

With this arrangement, a second fluid, such as air indicated by arrows A, flows over injection nozzle 38 and into passages 100 and 101. Fuel, indicated by arrows B, flows into injection nozzle 38 via inlet 88. The fuel then enters conduits 114 and 115 and flows into passages 100 and 101 respectively to mix with the air and form a combustible mixture. The combustible mixture, indicated by arrows C, then passes through the plurality of discharge passage exits 94, out from injection nozzle 38 and into combustion chamber 48.

Figure 5:
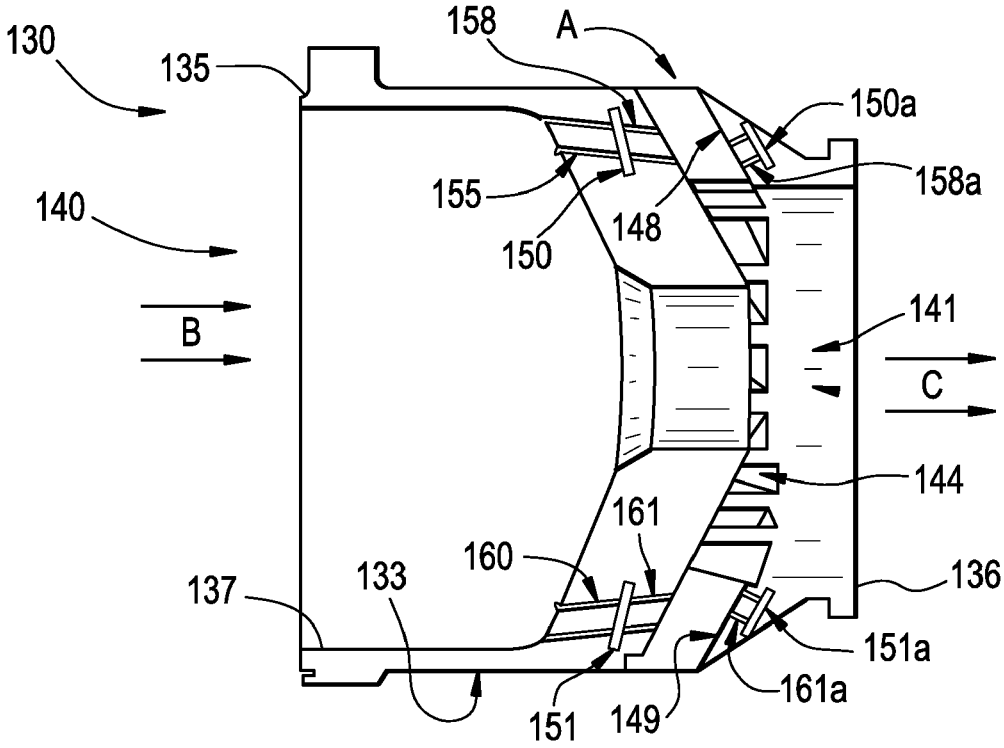
FIG. 5 is a cross-sectional view of an injection nozzle constructed in accordance with another exemplary embodiment of the invention.

Reference will now be made to FIG. 5 in describing an injection nozzle 130 constructed in accordance with another exemplary embodiment of the invention. As shown, injection nozzle 130 includes a main body 133 having a first end section 135 that extends to a second end section 136 defining an interior cavity or inner flow path 137. First end section 135 includes an inlet 140 for receiving a first fluid, such as a fuel, and second end section 136 includes an outlet 141 through which passes a combustible mixture of fuel and air as will be described more fully below. Towards that end, injection nozzle 130 includes a plurality of discharge passage exits 144 arranged at outlet 141.

In accordance with the exemplary embodiment shown, injection nozzle 130 includes a first passage 148 and a second passage 149 that extend through main body 133 at second end section 136. Although only two passages are shown, i.e., passages 148 and 149, it should be understood that a plurality of passages 148, 149 could be arrayed about main body 133. First and second passages 148 and 149 are fluidly connected to the plurality of discharge passage exits 144 and inner flow path 137 as will be described more fully below.

In the exemplary embodiment shown, injection nozzle 130 includes a first plenum 150 that extend within main body 133 and connects with passage 148 and a second plenum 151 that extends within main body 133 and connects with passage 149. More specifically, first plenum 150 extends about and connects with passage 148 while second plenum 151 extends about and connects with passage 149. At this point it should be understood that the particular number, placement and shape of plenums 150 and 151 can vary depending upon design requirements. As further shown in FIG. 5, injection nozzle 130 includes a first plurality of conduits 155 that extend between inner flow path 137 and first plenum 150 and a second plurality of conduits 158 that extend between first plenum 150 and the first passage 148. Similarly, a third plurality of conduits 160 extends between inner flow path 137 and second plenum 151 and a fourth plurality of conduits 161 extends between second plenum 151 and second passage 149. It should also be understood that injection nozzle 130 may include a third plenum **150*a* arranged axially outward and downstream of passage 148 and a fourth plenum 151*a* arranged axially outward and downstream of passage 149. Third plenum 150*a* is fluidly connected to passage 148 through a fifth plurality of conduits 158*a*, and fourth plenum 151*a* is fluidly connected to passage 149 through a sixth plurality of conduits 161*a***.

With this arrangement, a second fluid, such as air, indicated by arrows A, flows over injection nozzle 130 and into first and second passages 148 and 149. Fuel, indicated by arrows B, flows into injection nozzle 38 via inlet 140. The fuel then enters first and third plurality of conduits 155 and 160 and flows into first and second plenums 150 and 151 respectively. The fuel then flows from first and second plenums 150 and 151, through respective ones of the second and fourth plurality of conduits 158 and 161 into first and second passages 148 and 149 to mix with the air and form a combustible mixture. The combustible mixture, indicated by arrows C, then passes through the plurality of discharge passage exits 144 and out from injection nozzle 130 into combustion chamber 48. At this point it should be understood that exemplary embodiments of the invention provide a system for mixing first and second fluids to form a combustible mixture that is delivered into a turbomachine combustor.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A turbomachine comprising:

a compressor;

a combustor operatively connected to the compressor; and an injection nozzle operatively connected to the combustor, the injection nozzle including:

a main body having a first end section that extends to a second end section defining an inner flow path;

an outlet arranged at the second end section of the main body;

a plurality of passages extending within the main body at the second end and being fluidly connected to the outlet;

a plenum arranged within the main body at the second end, the plenum being fluidly connected with the plurality of passages;

a first plurality of conduits extending between and fluidly connected with the inner flow path and the plenum; and a second plurality of conduits extending between the plenum and the plurality of passages.

2. The turbomachine according to claim 1, further comprising: another plurality of conduits extending between the at least one plenum and the one of the first and second passages.

3. The turbomachine according to claim 1, further comprising: a plurality of discharge passage exits arranged at the outlet.

4. The turbomachine according to claim 1, wherein the first end section defines an inlet for receiving a first fluid.

5. A method of introducing a combustible mixture into a turbomachine combustor, the method comprising:

introducing a first fluid into an inner flow path of an injection nozzle, the injection nozzle including a first end section that extends to a second end section defining a main body, the main body including an outlet arranged at the second end section;

passing a second fluid into a plurality of passages extending substantially radially through the main body at the second end;

guiding the first fluid from the inner flow path through a plurality of conduits into a plenum arranged in the main body at the second end;

passing the first fluid from the plenum into the plurality of passages to mix with the second fluid to form a combustible mixture; and discharging the combustible mixture through the outlet into the turbomachine combustor.

6. An injection nozzle for a turbomachine comprising:

a main body having a first end section that extends to a second end section defining an inner flow path;

an outlet arranged at the second end section of the main body;

a plurality of passages extending within the main body at the second end and is fluidly connected to the outlet;

a plenum arranged within the main body at the second end, the plenum being fluidly connected with the plurality of passages;

a first plurality of conduits extending between and fluidly connected with the inner flow path and the plenum; and a second plurality of conduits extending between the plenum and the plurality of passages.

7. The injection nozzle according to claim 6, further comprising: another plenum arranged in the second end, the another plenum being fluidly connected with plurality of passages.

8. The injection nozzle according to claim 6, further comprising: a plurality of discharge passage exits arranged at the outlet.

9. The injection nozzle according to claim 6, wherein the first end section defines an inlet for receiving a first fluid.

* * * * *